United States Patent [19]

Shmeleva et al.

[11] Patent Number: 4,849,094

[45] Date of Patent: Jul. 18, 1989

[54] PROCESS FOR DESULPHURIZATION OF HEAVY PETROLEUM RESIDUES USING ELECTRIC CURRENT

[76] Inventors: Ljubov A. Shmeleva, ulitsa Gurieva, 10, kv. 48; Vladimir A. Chebyshev, ulitsa Gurieva, 17, kv. 38, both of Moskovskaya oblast, Ramenskoe; Roblen R. Turkov, ulitsa Rechnaya, 2, kv. 2, Moskovskaya oblast, Voskresensk; Vyacheslav T. Grokhotov, Perovsky prospekt, 28, Moskovskaya oblast, Ramenskoe; Jury B. Alexandrovich, Olimpiisky prospekt, 26, kv. 22, Moscow; Valentin I. Ulyantsev, ulitsa I-aya Krestyanskaya, I, korpus 2, kv. 58, Moskovskaya oblast, Mytischi; Dmitry F. Varfolomeev, ulitsa Bljukhera, 18, kv. 41; Boris G. Pecheny, prospekt Oktyabrya, 89/5. kv. 51, both of Ufa; Vladimir P. Vitaliev, 2-i Novopodmoskovny pereulok, 6, kv. 115; Viktor V. Sheludko, ulitsa Bekhtereva, 37, korpus 2, kv. 97, both of Moscow, all of U.S.S.R.

[21] Appl. No.: 163,965

[22] PCT Filed: Apr. 30, 1986

[86] PCT No.: PCT/SU86/00042

§ 371 Date: Nov. 30, 1987

§ 102(e) Date: Nov. 30, 1987

[87] PCT Pub. No.: WO87/06603

PCT Pub. Date: May 11, 1987

[51] Int. Cl.[4] ..... C10G 29/04

[52] U.S. Cl. ..... 208/208 R; 208/243; 208/247

[58] Field of Search ..... 208/208 R, 217, 247, 208/249, 197, 243

[56] References Cited

U.S. PATENT DOCUMENTS 3,949,914 3/1976 Yoo et al. ..... 208/208 R
4,336,130 6/1982 Miller et al. ..... 208/243

FOREIGN PATENT DOCUMENTS 2019433A 10/1979 United Kingdom .

*Primary Examiner*—Glenn Caldarola
*Attorney, Agent, or Firm*—Ladas & Parry

[57] ABSTRACT

A process for desulphurization of heavy petroleum residues comprises heating thereof to a temperature of from 190° to 200° C., passing a 4–20V electric current through the heated petroleum heavy residues and adding $Fe_2O_3$ and/or $Pb_3O_4$ and $Ba(OH)_2$ thereto in a weight ratio of the components of 1–10:1–20 respectively; in the case of using $Fe_2O_3$ and $Pb_3O_4$ simultaneously, their weight ratio is equal to 2–9:1–5 respectively.

4 Claims, No Drawings

PROCESS FOR DESULPHURIZATION OF HEAVY PETROLEUM RESIDUES USING ELECTRIC CURRENT

FIELD OF THE INVENTION

1. Background of the Invention

The present invention relates to processes for desulphurization of heavy petroleum residues.

These heavy petroleum residues find an extensive use in industry. Such heavy resides can be exemplified, by residual asphalt, boiler fuel, petroleum oils widely used as fuels, lubricants, as well as bitumens. Bitumens are employed in road construction, hydraulic engineering as hydroinsulation, roofing and anticorrosion materials, as well as a binder in the manufacture of bitumen-containing and heat-insulation materials. Bitumens also comprise raw materials in the production of petroleum coke.

2. Description of the Related Art

This wide application of heavy petroleum residues is possible owing to a wide range of useful properties thereof: heat- and frost-resistance, plasticity, good adhesion-cohesion characteristics, resistance in aggressive media, high dielectric properties. However, at a long-time exposure to high temperatures (up to 150° C.) a negative influence of sulphur compounds contained in petroleum residues starts to manifest itself. Sulphur compounds cause corrosion of steel structures. Electrical resistance of coatings, e.g. bitumen ones, gets substantially decreased upon exposure to a humid medium at an elevated temperature due to the presence of such compounds, i.e. sulphur compounds in heavy petroleum residues considerably lower their physico-mechanical characteristics. There are a number of processes aimed at reduction of the content of sulphur compounds (desulphurization of heavy petroleum residues by way of treatment thereof with various agents). Thus, known in the art is a process for desulphurization of petroleum oils (British Application No. 2,019,433; 1979). According to this process, petroleum oil is charged into a container and heated to a temperature of 120 to 350° C., whereafter sulphohydrates or hydrates of alkali metal sulphides (cesium, rubidium, potassium, sodium or lithium) are added thereto.

The process of desulphurization is conducted in the atmosphere of hydrogen under a pressure of up to 400kg/cm$^2$, the desulphurized product is separated from hydrates of an alkali metal hydroxide and from hydrates of an alkali metal sulphide or from a mixture of both. The recovery of contaminants from desulphurized petroleum oils is effected by passing steam therethrough.

This process makes it possible to obtain petroleum oils with a sufficiently low content of sulphur compounds; however, the process is rather complicated and expensive, since, it necessitates the use of hydrogen under a high pressure.

In another process heavy petroleum residues such as boiler fuel are continuously supplied into a reactor, wherein a stationary bed of a catalyst is provided. Simultaneously with the starting product hydrogen is supplied at a temperature within the range of from 315 to 455° C. under a pressure of from 14 to 700 atm. A stationary bed of catalyst particles contains 10 to 20% by weight of molybdenum oxide and/or 1 to 8% by weight of cobalt oxide supported on an oxide carrier. The product with a reduced content of sulphur compounds is withdrawn from the reactor (USSR Pat. No. 638267, 1977).

This process makes it possible to lower the content of sulphur by 80–85%, but this process also features a complicated scheme, since it necessitates the use of hydrogen; furthermore, preparation of the employed catalyst is associated with substantial process difficulties.

DISCLOSURE OF THE INVENTION

The present invention is directed to the provision of such a process for desulphurization of heavy petroleum residues which would make it possible to considerably lower the content of sulphur compounds in the starting product following a simplified procedure.

This object is accomplished by that in the process for desulphurization of heavy petroleum residues comprising heating of heavy petroleum residues to a temperature of 190°–200° C., their treatment by metal oxides and hydroxides and separation of disulphrized residues according to the present invention a DC current of 4–20V is passed through heated heavy petroleum residues and as metal oxides use is made of $Ba(OH)_2$ at a weight ratio of a proportionate range of $Fe_2O_3$:-$Ba(OH)_2$ of 1–10 parts $Fe_2O_3$ to 1–20 parts $BA(OH)_2$; of a proportionate range of $Pb_3O_4$:$Ba(OH)_2$ of 1–10 parts $Pb_3O_4$ to 1–20 parts $Ba(OH)_2$; of a proportionate range of $Fe_2O_3$:$Pb_3O_4$:$Ba(OH)_2$ when $Fe_2O_3$ and $Pb_3O_4$ are used simultaneously with $Ba(OH)_2$ of 2–9 parts $Fe_2O_3$ to 1–5 parts $Pb_3O_4$ to 1–20 parts $Ba(OH)_2$.

As the heavy petroleum residues it is possible to use, for example, boiler fuel, residual asphalt, petroleum oils, bitumen. At a selected temperature and voltage the starting stock acquires properties of a Newtonian fluid, wherein solid fractions (metal oxides and hydroxides) can readily move. Upon application of an electric field the process of electrolysis starts in molecules and the most complete neutralization of sulphur compounds takes place.

The selected amounts of metal oxides and hydroxides are necessary and sufficient to ensure the maximum degree of desulphurization of sulphur compounds contained in the starting product.

SUMMARY OF THE INVENTION

The process according to the present invention makes it possible to lower the content of sulphur compounds by 90–95%. The process necessitates no use of a special equipment or of expensive hydrogen. The process is economically efficient. In the Table hereinbelow physico-mechanical characteristics of some petroleum residues before and after their desulphurization by the process according to the present invention are shown.

The service life of pipelines insulated by the bitument desulphurized by the process according to the present invention is extended from 10 to 25 years.

TABLE

| No. 1 | Characteristics 2 | Bitumen Initial 3 | Bitumen Desulphurized 4 |
|---|---|---|---|
| 1. | Sulphur content, % | 2.47 | 0.3 |
| 2. | pH before heat-treatment | 7.05 | 7.05 |
| | pH after heat-treatment at 150° C. for 1,000 hours | 3.0 | 7.0 |
| 3. | Volume resistivity, Ohm.cm | $10^{14}$ | $10^{14}$ |
| 4. | Volume resistivity, Ohm.cm, after thermo-humid treatment | $10^{3}$ | $10^{13}$ |

TABLE-continued at 75 ± 5° C. for 250 hours

| | Boiler Fuel | | Residual Asphalt | | Petroleum Oils | |
|---|---|---|---|---|---|---|
| No. | Initial | Desulphurized | Initial | Desulphurized | Initial | Desulphurized |
| 1 | 5 | 6 | 7 | 8 | 9 | 10 |
| 1. | 2.25 | 0.29 | 2.33 | 0.28 | 1.97 | 0.27 |
| 2. | 7.0 | 7.0 | 7.1 | 7.1 | 7.0 | 7.0 |
| | 3.0 | 7.0 | 3.0 | 7.0 | 3.0 | 7.0 |
| 3. | $10^{13}$ | $10^{13}$ | $10^{13}$ | $10^{13}$ | $10^{11}$ | $10^{11}$ |
| 4. | $10^{3}$ | $10^{12}$ | $10^{3}$ | $10^{12}$ | $10^{3}$ | $10^{10}$ |

DESCRIPTION OF THE PREFERRED EMBODIMENTS

The process is technologically simple and can be practiced in the following manner.

Into a vessel provided with a stirrer heavy petroleum residues are charged and heated to a temperature of 190°–200° C., followed by passing electric current with a voltage of 4–20V through the product. Then a powder-like mixture is added which consists of $Fe_2O_3$ and/or $Pb_3O_4$ and $Ba(OH)_2$ in selected proportions. The desulphurized petroleum residues are separated from impurities by any conventional method, for example by centrifugation or sedimentation.

For a better understanding of the present invention some specific Examples are given hereinbelow by way of illustration.

EXAMPLE 1

Into a vessel provided with a stirrer 1,000 g of bitumen containing 2.47% of sulphur are charged. The bitumen is heated to the temperature of 190° C., whereafter electric current of 12V voltage is passed through the heated bitumen. Then a powderlike mixture consisting of $Fe_2O_3$ and $Ba(OH)_2$ in the weight ratio of the components equal to 1:2 respectively is added thereto. The process duration is 45 minutes, whereafter the current source is switched-off and the stirrer is stopped. The process duration is 45 minutes, whereafter the current source is switched-off and the stirrer is stopped. The thus-obtained mass is kept at the above-mentioned temperature for one hour; as a result, two layers are formed: the upper layer - liquid desulphurized bitumen with the content of sulphur of 0.3% and the lower layer - solid impurities which are then separated.

EXAMPLE 2

The experiment is carried out under the conditions specified in Example 1 hereinabove, except that the starting bitumen contains 4.86% of sulphur; it is heated to the temperature of 200° C. and the voltage is 4V. The weight ratio of the components $Fe_2O_3$:$Ba(OH)_2$ =8:9. As a result, the content of sulphur in the final product is equal to 1.98%.

EXAMPLE 3

Into a vessel provided with a stirrer 1,000 g of a residual asphalt are charged which contains 2.33% of sulphur. The residual asphalt is heated to the temperature of 195° C., whereafter electric current of 8V voltage is passed through the heated residual asphalt and then a powder-like mixture is added thereto which consists of $Fe_2O_3$ and $Ba(OH)_2$ employed in the weight ratio therebetween of 1:2 respectively.

The process duration is 60 minutes. Then the electric current source is switched-off and the stirrer is stopped.

The obtained mass is kept at the above-specified temperature for one hour so that two layers are formed: the liquid layer—desulphurized residual asphalt with the content of sulphur of 0.27%; the lower layer comprises solid impurities which are then separated.

EXAMPLE 4

Into a vessel provided with a stirrer 1,000 g of bitumen containing 5.05% of sulphur are charged. The bitumen is heated to the temperature of 190° C., whereafter electric current of 15V voltage is passed through the heated bitumen. Then a powderlike mixture consisting of $Pb_3O_4$ and $Ba(OH)_2$ in the weight ratio of 4:5 between the components respectively is added thereto. The process duration is 45 minutes. Then the electric current source is switched-off and the stirrer is stopped. The thus-obtained mass is kept at the above-specified temperature for one hour so that two layers are formed: the upper layer comprises liquid desulphurized bitumen with a content of sulphur of up to 2.09% and the lower layer - solid impurities which are then separated.

EXAMPLE 5

The experiment is carried out under the same conditions as those described in the foregoing Example 4, except that the content of sulphur in the starting bitumen is 2.79%, the process temperature is 200° C., voltage 4V, weight ratio of the components $Pb_3O_4$ and $Ba(OH)_2$=7:10. As a result, the content of sulphur in the desulphurized bitumen is 0.74%.

EXAMPLE 6

Into a vessel provided with a stirrer 1,000 g of boiler fuel containing 2.25% of sulphur are charged. The mazout is heated to the temperature of 190° C., whereafter electric current of 15V voltage is passed through the heated boiler fuel and then a powderlike mixture consisting of $Fe_3O_3$, $Pb_3O_4$ and $Ba(OH)_2$ is added thereto in the weight ratio between the components of 2:1:2 respectively.

The process duration is 50 minutes. Then the electric current source is switched-off and the stirrer is stopped. The resulting mass is kept at the above-specified temperature for one hour to form two layers: the liquid layer comprising desulphurized boiler fuel with the content of sulphur of 0.29% and the lower layer comprising solid impurities which are then separated.

EXAMPLE 7

Into a vessel provided with a stirrer 1,000 g of bitumen containign 3.29% of sulphur are charged. Bitumen is heated to the temperature of 200° C., whereafter electric current of 20V voltage is passed through the heated bitumen and then a powderlike mixture consisting of $Fe_2O_3$, $Pb_3O_4$ and $Ba(OH)_2$ is added thereto in the weight ratio of the above-mentioned components of 2:1:3 respectively. The process duration is 45 minutes, whereafter the electric current source is switched-off and the stirrer is stopped. The resulting mass is kept at the abovespecified temperature for one hour to give two layers: the upper layer comprising liquid desulphurized bitumen with the content of sulphur of 1.02% and the lower layer comprising solid impurities which are then separated.

EXAMPLE 8

The experiment is conducted under conditions described in Example 7, except that the content of sulphur in the starting bitumen is 2.91%, the process temperature is 195° C., voltage 4V, the weight ratio between the components $Fe_2O_3$, $Pb_3O_4$ and $Ba(OH)_2$ is equal to 4:5:12 respectively. As a result, the content of sulphur in the desulphurized bitumen is 0.52%.

EXAMPLE 9

Into a vessel provided with a stirrer 1,000 g of petroleum oil containing 1.97% of sulphur are charged. The oil is heated to the temperature of 190° C., whereafter electric current of 6V voltage is passed through the heated oil and then a powder-like mixture consisting of $Fe_2O_3$, $Pb_3O_4$ and $Ba(OH)_2$ is added thereto in the weight ratio between the components of (:1:20 respectively.

The process duration is 45 minutes, whereafter the electric current source is switched-off and the stirrer is stopped. The thus-obtained mass is kept at the above-specified temperature for one hour so that two layers are formed: the upper layer comprising liquid desulphurized oil with the content of sulphur of 0.27% and the lower layer comprising solid impurities which are separated.

INDUSTRIAL APPLICABILITY

Heavy petroleum residues desulphurized by the process according to the present invention can be useful in industry as a fuel, lubricants, hydro-insulation, roofing, corrosion-preventing and heat-insulation materials.

We claim:

1. A process for desulphurization of heavy petroleum residues comprising heating said heavy petroleum residues to a temperature of 190 to 200° C., introducing oxides and hydroxides of metals, passing an electric current of 4–20V DC through the heated heavy petroleum residues, using as the oxides $Fe_2O_3$ and/or $Pb_3O_4$ and as the hydroxide $Ba(OH)_2$ in a weight ratio of a proportionate range of $Fe_2O_3$:$Ba(OH)_2$ of 1–10 parts $Fe_2O_3$ to 1–20 parts $Ba(OH)_2$; of a proportionate range of $Pb_3O_4$:$Ba(OH)_2$ of 1–10 parts $Pb_3O_4$ to 1–20 parts $Ba(OH)_2$; of a proportionate range of $Fe_2O_3$:$Pb_3O_4$:-$Ba(OH)_2$ when $Fe_2O_3$ and $Pb_3O_4$ are used simultaneously with $Ba(OH)_2$ of 2–9 parts $Fe_2O_3$ to 1–5 parts $Pb_3O_4$ to 1–20 parts $Ba(OH)_2$, and separating desulphurized residues.

2. A process as claimed in claim 1, characterized in that the process is conducted with a weight ratio of $Fe_2O_3$ to $Ba(OH)_2$ being 1–8 to 2–10 respectively.

3. A process as claimed in claim 1, characterized in that the process in conducted with a weight ratio of $Pb_3O_4$ to $Ba(OH)_2$ being 4–7 to 5–10 respectively.

4. A process as claimed in claim 1, characterized in that the process is conducted with a weight ratio of $Fe_2O_3$ to $Pb_3O_4$ to $Ba(OH)_2$ being 2–9 to 1–5 to 2–20 respectively.

* * * * *